US005784959A

United States Patent [19]

Larios

[11] Patent Number: 5,784,959

[45] Date of Patent: Jul. 28, 1998

[54] HAND-HELD PRINTER AND METHOD FOR ADHESIVE TAPE

[76] Inventor: Frank N. Larios, 1827 Woodacre Way, Roseville, Calif. 95661

[21] Appl. No.: 677,598

[22] Filed: Jul. 9, 1996

[51] Int. Cl.[6] ..... B41F 5/04

[52] U.S. Cl. ..... 101/219; 101/492

[58] Field of Search ..... 101/212, 219, 101/226, 492

[56] References Cited

U.S. PATENT DOCUMENTS

| | | | |
|---|---|---|---|
| 1,496,331 | 6/1924 | Wheelock | 101/212 |
| 2,302,179 | 11/1942 | Bronfman | 101/212 |
| 2,323,976 | 7/1943 | Chalmers | 101/216 |
| 2,432,202 | 12/1947 | Mason | 101/227 |
| 2,495,389 | 1/1950 | Sammann | 101/227 |
| 2,515,423 | 7/1950 | Ptasnik | 117/44 |
| 2,598,892 | 6/1952 | Critchlow, Jr. et al. | 101/483 |
| 4,068,028 | 1/1978 | Samonides | 428/41.4 |
| 4,857,134 | 8/1989 | Lin | 156/385 |
| 5,197,386 | 3/1993 | Lin | 101/213 |
| 5,254,206 | 10/1993 | Wing | 156/542 |

FOREIGN PATENT DOCUMENTS

| | | | |
|---|---|---|---|
| 55-144166 | 11/1980 | Japan | 101/219 |

*Primary Examiner*—Edgar S. Burr
*Assistant Examiner*—Amanda B. Sandusky
*Attorney, Agent, or Firm*—Kenneth L. Nash

[57] ABSTRACT

Hand-held printing apparatus and method are disclosed that provide a replaceable ink cartridge with an ink reservoir defined therein to store wet ink that may typically have a paste like consistency. A piston movable within the ink cartridge is operably connected to the tape spool for compressing the wet ink through a nozzle of the ink cartridge onto the first of a series of printing rollers that smooth out the ink for transfer to a printing roller to effect offset printing of a desired image onto the adhesive side of clear adhesive tape. The cartridge is provided in a low cost throw away package for disposal after the ink is depleted. Multiple color logos or images can be printed by using two to four different color ink cartridges. The flow of wet ink may be controlled by gearing, relative size adjustment of the components, pneumatic pressure control, adjusting or altering start/stop position of components, or increasing the number of actuating components that actuate each pumping action per revolution of the tape spool.

19 Claims, 4 Drawing Sheets

HAND-HELD PRINTER AND METHOD FOR ADHESIVE TAPE

BACKGROUND OF THE INVENTION

1. Field of the Invention

The present invention relates generally to hand-held printer assemblies and, more particularly, to apparatus and methods for printing on adhesive tape with wet ink.

2. Description of the Background

It has been well known for many years that businesses have long had a strong desire to place their logo or trademarks on products manufactured or shipped. One motivation for this is simply increased marketing and advertising. Another factor is that trademark law actually requires that a company affix or apply, in some suitable manner, its mark to the goods to maintain validity of the mark. Furthermore, frequent and consistent usage of the trademark increases the value as the mark is seen more frequently and becomes more well known. The value of some trademarks may be worth many millions of dollars because consumers know, trust, and like to buy products from the company with which they are familiar and have been satisfied in the past. Large advertising budgets are often provided to associate many people with a company's mark of quality.

However, the use of custom made boxes or labels to display the logo of the company may be prohibitively expensive. Another method of displaying logos and trademarks requires affixing customized packing tape on boxes during packaging. However, the cost of specially made tape for such purposes is also quite high. Thus, notwithstanding the desirability of using tape for such purposes, it has more generally been found to be impractically expensive.

However, inventors have long recognized the value of a hand-held tape dispenser that is able to print such marks and logos simultaneously with packaging. The following patents are representative of the long-felt need and past efforts to provide a suitable hand-held printer for this purpose.

U.S. Pat. No. 2,302,179, issued Nov. 17, 1942, to B. Bronfman, discloses an apparatus to provide a transparent adhesive tape having printed matter formed of dry pigmentary material impressed upon the tacky, pressure sensitive adhesive coating of the tape. Other patents reviewing this apparatus report that the resulting image is not always sufficiently sharp.

U.S. Pat. No. 2,432,202, issued Dec. 9, 1947, to E. W. Mason, utilizes a substantially solid body of chalk and a felt roller to transfer abrading particles to a hard rubber roller that imprints cellulose tape to purportedly effect simultaneously marking, labeling, sealing, and identifying of the packaged merchandise.

U.S. Pat. No. 4,068,028, issued Jan. 10, 1978, to J. Samonides, discloses an apparatus for de-laminating a sheet material comprising a face sheet having an adhesive coating on the rear surface thereof and a backing sheet attached to and covering the adhesive coating, and for printing indicia on either the adhesive coating or the front surface of the face sheet.

U.S. Pat. No. 4,857,134, issued Aug. 15, 1989, to Lin et al., discloses a carton sealing tape sticker and cutter consisting of an auxiliary roller pivoted between the main roller and a word printing device with a word roller having raised words or figures.

U.S. Pat. No. 5,254,206, issued Oct. 19, 1993, to D. B. Wing, discloses an apparatus for administering self-adhesive labels that applies labels with a wiping motion rather than a rotating motion.

U.S. Pat. No. 5,197,386, issued Mar. 30, 1993, to S. Lin, discloses a hand-held packaging tape dispenser having a printing mechanism for printing on the leading edge of the packaging tape and a tape stretching mechanism to stretch the tape for printing.

Despite the effort demonstrated by these patents, there remains a need for a hand-held printing assembly that offers dependable operation and excellent printing using a print roller and easily replaceable wet ink cartridge. Those skilled in the art have long sought and will appreciate the present invention which addresses these and other problems.

SUMMARY OF THE INVENTION

The hand-held printer of the present invention provides methods for printing on adhesive tape with wet ink. The apparatus comprises a tape reel for holding the adhesive tape. A plate roller applies an imprint on the adhesive tape, preferably on the adhesive side of the tape, with the wet ink. An ink cartridge contains an ink cartridge reservoir therein for the wet ink. The ink cartridge has at least one aperture therein to dispense the wet ink. A compressor is operable to compress the wet ink within the ink cartridge reservoir to force the wet ink through the at least one aperture for application to the plate roller. Preferably, a retainer releasably retains the ink cartridge within the hand-held printer. At least one ink roller is preferably provided to evenly transfer the wet ink to the plate roller. A gear attached to the tape reel is operably connected to the compressor for compressing the ink in response to movement of the tape reel. A receptacle defined within the hand-held printer receives the ink cartridge reservoir. A second plate roller for applying a second color of wet ink may be provided for use with a second ink reservoir containing the second color wet ink.

In one embodiment, a first ring having a wedge-shaped profile is provided for compressing ink. The movable member is disposed adjacent the outlet, where the first ring preferably is also disposed. The movable member is responsive to movement of said adhesive tape. In one embodiment, the first ring drives the moveable member into the reservoir to act as a compressing plunger. In this embodiment, the movable member may preferably be reciprocally movable as the reservoir is depleted of the wet ink.

In another embodiment, a threaded shaft extends through the ink cartridge reservoir with the compressor being movably secured to the shaft. A compressing member, such as a piston, is moveable towards the outlet as the reservoir is depleted of the wet ink. A rotatable cylinder, in this embodiment, is then operably connected to the compressor for compressing the wet ink.

In operation, the adhesive tape moves through the hand-held printer past a printing roller. Wet ink is passed through an aperture in the ink cartridge and is applied to the printing roller. The wet ink is replenished by replacing the ink cartridge.

It is an object of the present invention to provide an improved hand-held printer and method.

It is another object of the present invention to provide a hand-held printer with a replaceable wet ink cartridge.

It is yet another object of the present invention to provide a hand-held printer that can print in more than one color using more than one printing plate and more than one color wet ink.

A feature of the present invention is an ink cartridge with a compressible member, such as a piston or plunger, to compress the wet ink out of the cartridge and to the printing plate.

Another feature of one embodiment of the present invention is a wedge shaped ring to drive the compressible member.

Yet another feature of another embodiment of the present invention is a plunger than moves through the ink cartridge.

An advantage of the present invention is an easy way to place logos or other desired information onto adhesive tape as it is used rather than having to purchase specially printed tape.

These and other objects, features, and advantages of the present invention will become apparent from the drawings, the descriptions given herein, and the appended claims.

While the present invention will be described in connection with presently preferred embodiments, it will be understood that it is not intended to limit the invention to those embodiments. On the contrary, it is intended to cover all alternatives, modifications, and equivalents included within the spirit of the invention and as defined in the appended claims.

DETAILED DESCRIPTION OF THE PREFERRED EMBODIMENTS

Figure 1:
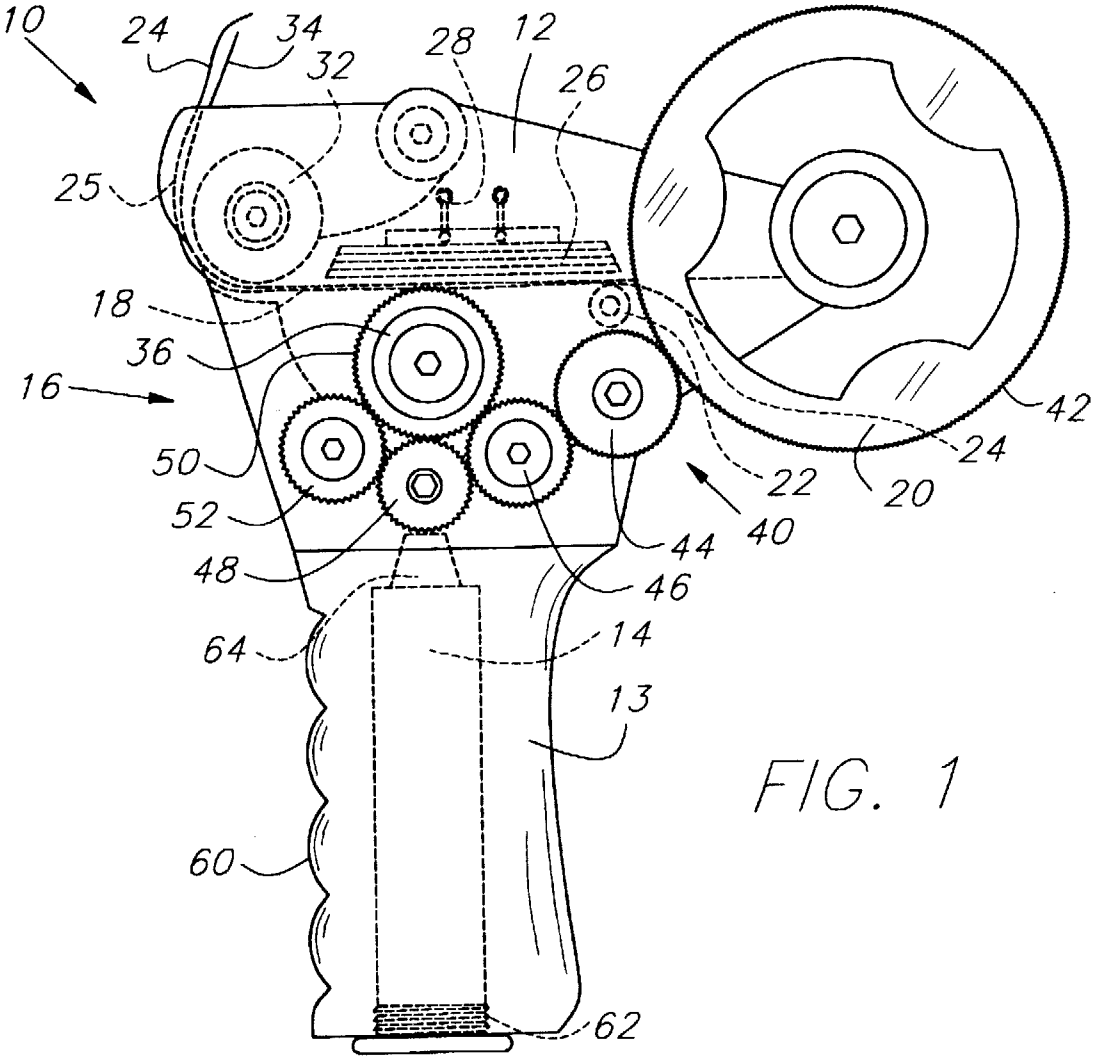
FIG. 1 is an elevational view of hand-held printer for adhesive tape in accord with the present invention.

Referring now to the drawings, and more particularly to FIG. 1, the general configuration of hand-held printer 10, in accord with the present invention, is illustrated.

As a general overview of a hand-held printer in accord with the present invention, FIG. 1 shows that printer 10 is comprised of frame 12, hand grip 13, one or more ink cartridges represented schematically by cartridge 14, printer assembly 16, adhesive tape path 18, and related elements such as adhesive tape spool 20. The printer assembly 16 may preferably operate in accord with the basic tenants of offset printing such that no attempt is made herein to describe the various theories, variations, and principles of operation of such printing processes. As well, hand-held printer 10 includes numerous common components for a tape dispenser that are described herein only generally. Frame 12 may preferably have two opposing support sides to support therebetween the components of hand-held printer 10 such as rollers, tape path 18, and the printer assembly 16.

Tape path 18 is defined by pre-roller 22 that guides tape 24 from spool 20. Tape spool 20 may be a standard replaceable, roll of tape 24 such, such as clear tape, preferably adhesive on one side, as is commercially available. Hinged guide member 26 may open via hinges 28 to permit tape 24 to stay in tape path 18 especially as it engages print roller 36. Print roller 36 is a cylindrical roller, that preferably is replaceable itself or contains a replaceable polymer or other construction printing plate 30. Print roller 36 may be substantially flat with surfaces suited to repel/attract water for standard offset printing or, if desired, have raised or lowered printing images defined thereon. This provides the ability to provide different printing images as desired. The general cylindrical nature of print roller 36 may be seen more clearly from the side in FIG. 2, discussed hereinafter.

The imprinted message, such as a logo or trademark, is preferably printed on the sticky adhesive side 25 of tape 24. The output of tape path 18 is defined by outlet roller 32. Tape 24 extends from hand-held printer 10 for placement upon packages. Cutter 34, or other means, may be used to conveniently cut tape 24 after use for packaging, as desired.

Printer assembly 16 is preferably driven by gear train 40 and may include large gear 42 conveniently secured for movement with tape spool 20. Gear train 40 is may be mounted externally with respect to frame 12 as shown in FIG. 1 but could be mounted internally, if desired. Large gear 42 drives printer assembly 16 as tape is removed from spool 20. Other means for driving printer assembly 16 are possible, including friction drive using tape 24 itself. However providing a non-slip drive, such as the gear drive, may preferably be used for a highly consistent printing result.

Idler gear 44 drives the gear train elements that, in the present embodiment, are each connected to a corresponding printing roller. Other configurations of printing rollers may be arranged in other ways so that the rollers are not all gear driven, as in the present configuration. The printing rollers smoothly transfer a controlled amount of wet ink to print roller 36 as discussed further hereinafter. For this purpose, idler gear 44 drives gear 46. Gear 46, in this embodiment, drives both gears 48 and 50 that, in turn, drive gear 52. Portions of the respective print rollers may be seen in FIG. 2. Roller 54 receives wet ink and transfers it to roller 56 where the ink is transferred again to printing roller 36. While the present embodiment uses three ink transfer/smoothing/spreading rollers, other numbers of rollers could be used. The number of rollers used and size thereof may be varied depending on the consistency and type of wet ink that is transferred from wet ink cartridge, shown conceptually as ink cartridge 14.

Hand grip 13 includes an easily gripped portion 60 that may be conveniently held in the hand by an operator while dispensing tape 24. In the present embodiment, hand grip 13 also houses a wet ink cartridge, such as wet ink cartridge 14, that is used to store and dispense wet ink. However, it will be understood that ink cartridge 14 may be mounted wherever it is considered to most convenient for operation and is not necessarily mounted within hand grip 13. The overall shape of cartridge 14 may also be adapted as desired so long as ink cartridge 14 is suitable for storing wet ink so as to be a reservoir of the ink. In the conceptual model of FIG. 1, threaded cap 62 is used to hold cartridge 14 in position. Wet ink is dispensed to the rollers from dispenser element 64 that may preferably contain passage holes therein out of which ink may flow in a regulated manner as discussed hereinafter.

By wet ink, it is generally meant that the ink is not in a dry particulate, chalk, or other dry form. The presently preferred wet ink is paste-like and preferably has a consistency similar to that of toothpaste. Other embodiments for the consistency of the wet ink may possibly include various forms such as various viscosity liquids, gels, pulps, mashes, and the like. The dispensed ink is preferably not so thin that it runs or leaks. Since it is applied preferably to the underside of the clear tape that is placed on cartons, smearing and drying are not usually a problem. Because it is viscous, various method/devices may be used to compress the wet ink to move it onto the print rollers including purely mechanical or pneumatic means such as balloons, gas driven diaphragms, or gas applied to pistons such as piston 318 in FIG. 5, discussed hereinafter.

Figure 2:
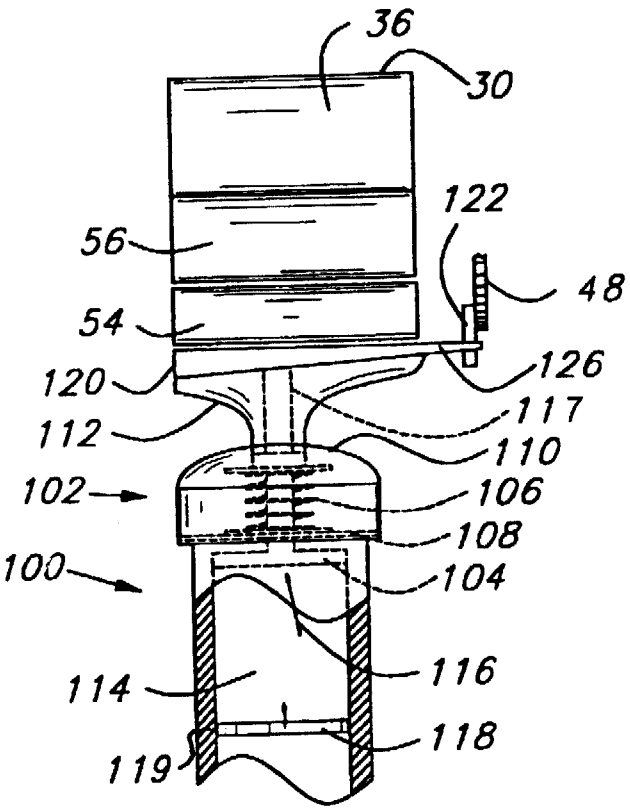
FIG. 2 is an elevational view of a ink cartridge with a pump for transferring wet ink to a printer section in accord with the present invention.

One presently preferred embodiment of an ink cartridge in accord with the present invention is shown in FIG. 2 as ink cartridge 100. Ink cartridge 100 includes an ink pump 102. Ink pump 102 includes plunger 104, bias spring 106, spring support plate 108, cap 110, and reciprocable nozzle 112. In this embodiment, reciprocable nozzle 112 is pressed downwardly as referenced in FIG. 2, to thereby move plunger into wet ink reservoir 114 that contains wet ink 116. It will be noted that while terms such as "downwardly", "upwardly" and the like may be used in this specification to more clearly describe the invention, they are in no way considered to limit the invention and are provided purely for the convenient understanding of the invention while viewing the corresponding drawings. It will be obvious to those skilled in the art that the directions of movement of the various components described may well change during operation, storage, and the like.

As plunger 104 moves into wet ink reservoir 114, wet ink 116 is compressed and moves through passage 117 where it is dispensed to roller 54. The rollers then spread and smooth out wet ink 116. As wet ink 116 is compressed so as to leave wet ink reservoir 114, piston 118 moves upwardly within wet ink reservoir 114 due to atmospheric pressure. Piston 118 continues to move upwardly in wet ink reservoir 114 until wet ink 116 is exhausted. Reservoir wall 119 preferably has ridges, tabs, or grooves disposed therein to prevent downwardly movement of piston 118 so that piston 118 moves in only one direction, i.e., upwardly. In this way, only wet ink 116 moves in response to compression, while piston 118 moves upwardly when pressure inside the reservoir is below atmospheric pressure, i.e., when plunger 104 moves upwardly. There may also be provided an indicator, window, or the like that shows when the cartridge is empty. At that time, cartridge 100 is, preferably, replaced. Alternatively, means (not shown) could be provided for refilling cartridge 100.

Figure 3:
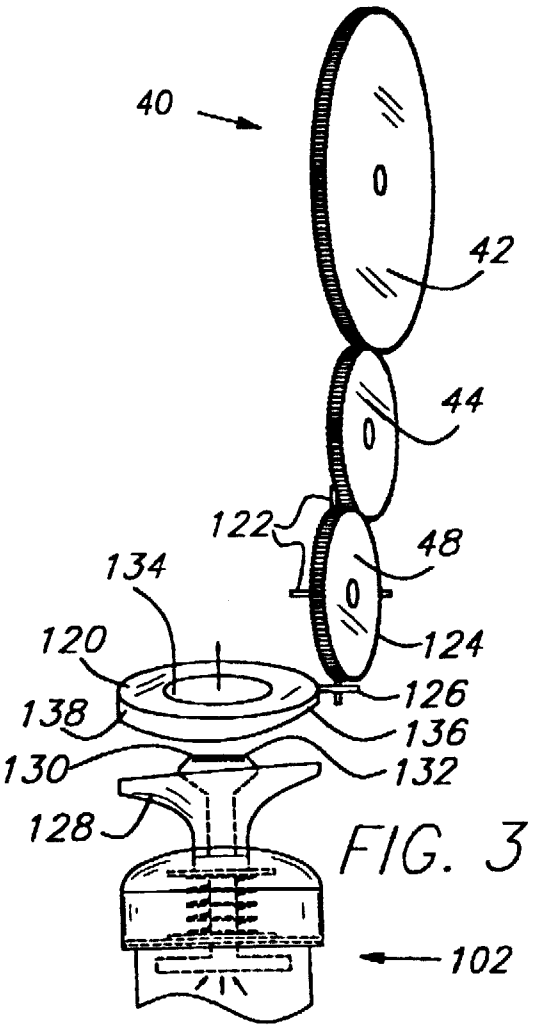
FIG. 3 is a perspective view of a gear drive for actuating the pump of FIG. 2.

Reciprocal nozzle 112 is forced to move downwardly when wedge-shaped ring 120 rotates. As suggested by FIG. 2 and FIG. 3, wedge-shaped ring 120 rotates in response to tabs 122 that are mounted on circumference 124 of gear 48. Tabs 122 engage tab 126 which is mounted on wedge-shaped ring 120. Wedge-shaped flange portion 128 forms the upper portion of reciprocal nozzle 112. Because ring 120 and flange portion 128 are both wedge-shaped, flange portion 128 has to move downwardly when ring 120 rotates. Wedge-shaped ring 120 may be braced by a socket or support members (not shown), other than roller 54, that allow rotation to occur while preventing axial movement. Alternatively, wedge-shaped ring 120 may be rotatably secured to cartridge 100 by means not shown. Wet ink 116 acts as a lubricant between ring 120 and flange portion 128. After tabs 122 rotate past tab 126, wedge-shaped ring 120 returns to its original rotation position in response to pressure from spring 106. Each tab 122, therefore, causes one pump action. To increase wet ink flow, the number of tabs 122 may be augmented. Alternatively, for decreased wet ink flow, the number of tabs 122 may be decreased. The relative size of tabs 122 and tab 126 may, in addition, be varied to control the wet ink flow per pump action. Thus, ink flow can be highly regulated. Ink flow occurs through holes 130 in nozzle protrusion 132. Ink then flows through hole 134 in wedge-shaped ring 120 to roller 54. It will be understood that wedge-shaped ring 120 is preferably circular as viewed from the top or bottom indicated in FIG. 3 and has a wedge profile that tapers from thick edge 138 towards narrow edge 136 as viewed from the side. Flange portion 128 has a mating profile such that smooth sliding contact is made between wedge-shaped ring 120 and wedge-shape flange portion 128.

It will be understood that various modifications could be made of wedge-shaped ring 120 and corresponding flange portion 128. For instance, multiple wedges, ridges, inclines, or sloping teeth, (not shown) could be provided around the circumference of ring 120 and flange 128 so that rotation therebetween would cause the same axial movement as does relative rotation of the presently illustrated wedge shaped ring 120 and corresponding flange 128. The amount of the axial movement produced due to the relative rotation could be adjustably or fixably controlled by numerous means such as lever to control the relative starting/stopping positions, with respect to the sloping teeth, of ring 120 and flange 128 for each pump stroke of the plunger. In this case, ring 120 may continue to rotate and need not be spring-loaded for movement back to the original circumferential starting position. From this discussion, and as discussed hereinafter, it will be understood, that numerous means can be provided to regulate and control flow of wet ink 116.

Spring 106 may be adjusted in strength to force reciprocal nozzle 112 upwardly and, thereby, rotate wedge-shaped ring 120 to its initial position. As well, an additional assist spring may be mounted parallel to ring 120 (not shown) to assist the return of wedge-shaped ring to the initial or rest position to which it returns between pump actions i.e., after contact between the tabs is lost due to rotation of the gears.

Figure 4:
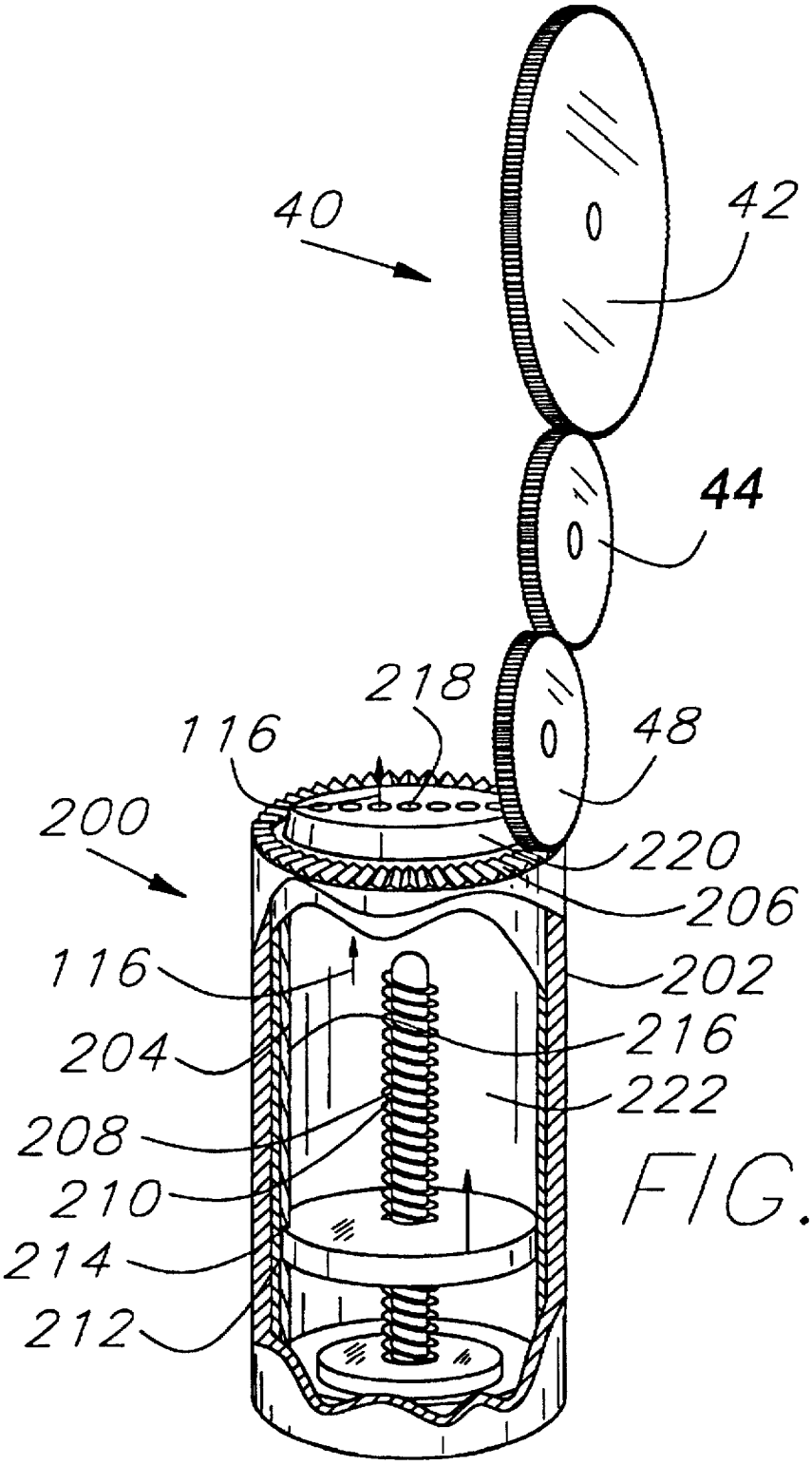
FIG. 4 is a perspective view, partially in section, of another drive for pumping wet ink in accord with the present invention.

An alternative cartridge 200, in accord with the present invention, is shown in FIG. 4. Cartridge 200 had an outer drive cylinder 202 and an inner storage cylinder 204. Inner storage cylinder provides an ink reservoir 222 for wet ink 116 defined at the bottom by piston 212. Drive train 40 engages upper gear 206 to rotate outer drive cylinder 202. Threaded bolt 208 is preferably fixed onto outer drive cylinder 202 and rotates therewith. Threads 210 force piston 212, which is internally threaded, in an upward direction as indicated in FIG. 4 to compress wet ink 116 through apertures 218 at the upper portion of cartridge 200. Piston 212 has grooves 214 that engage rail 216 to prevent rotation so that piston 212 must move axially along bolt 208 in response to rotation of bolt 208. Nozzle 220, that contains apertures 218, is preferably non-circular, keyed, or eccentric so as to fit into a corresponding socket (not shown) that is fixed to frame 12 so that inner storage cylinder 204 cannot rotate.

Although seals and bearings are not indicated in this or other cartridge embodiments, they are provided as necessary depending on the size of cartridge 200 as will be common knowledge to those skilled in the art. If the components are formed of polymers, plastics, metals, and the like, additional seals and bearings may not be needed at all. For instance, a plastic material piston 212 may seal adequately and lubricated polymer surfaces of an outer cylinder 202 may provide suitable bearing action. Preferably, the ink cartridge is replaced after each use so that it is not necessary to provide for long wearing components in the ink cartridge. It will also be noted that numerous controls are available to provide precise control of flow rate of the wet ink. For the system of FIG. 4, the threads 208, gear ratios of gear train 40, and the like may be used.

It will also be apparent to those skilled in the art that many variations of the ink cartridges could be made. For instance, a single outer drive cylinder could be used for both drive purposes and storage purposes. In such an embodiment, a threaded bolt could be used that is fixably positioned with respect to frame 12 but rotatable with respect to the single outer drive cylinder. A retainer/plug for the cartridge, such as threaded plug 62 shown in FIG. 1, could include means to prevent threaded bolt from rotating while, at the same time, fixing the axially position of cartridge for rotation within the handle. Other embodiments of the ink cartridge may also be imagined after viewing the embodiments disclosed hereinbefore that are in accord with the present invention.

Figure 5:
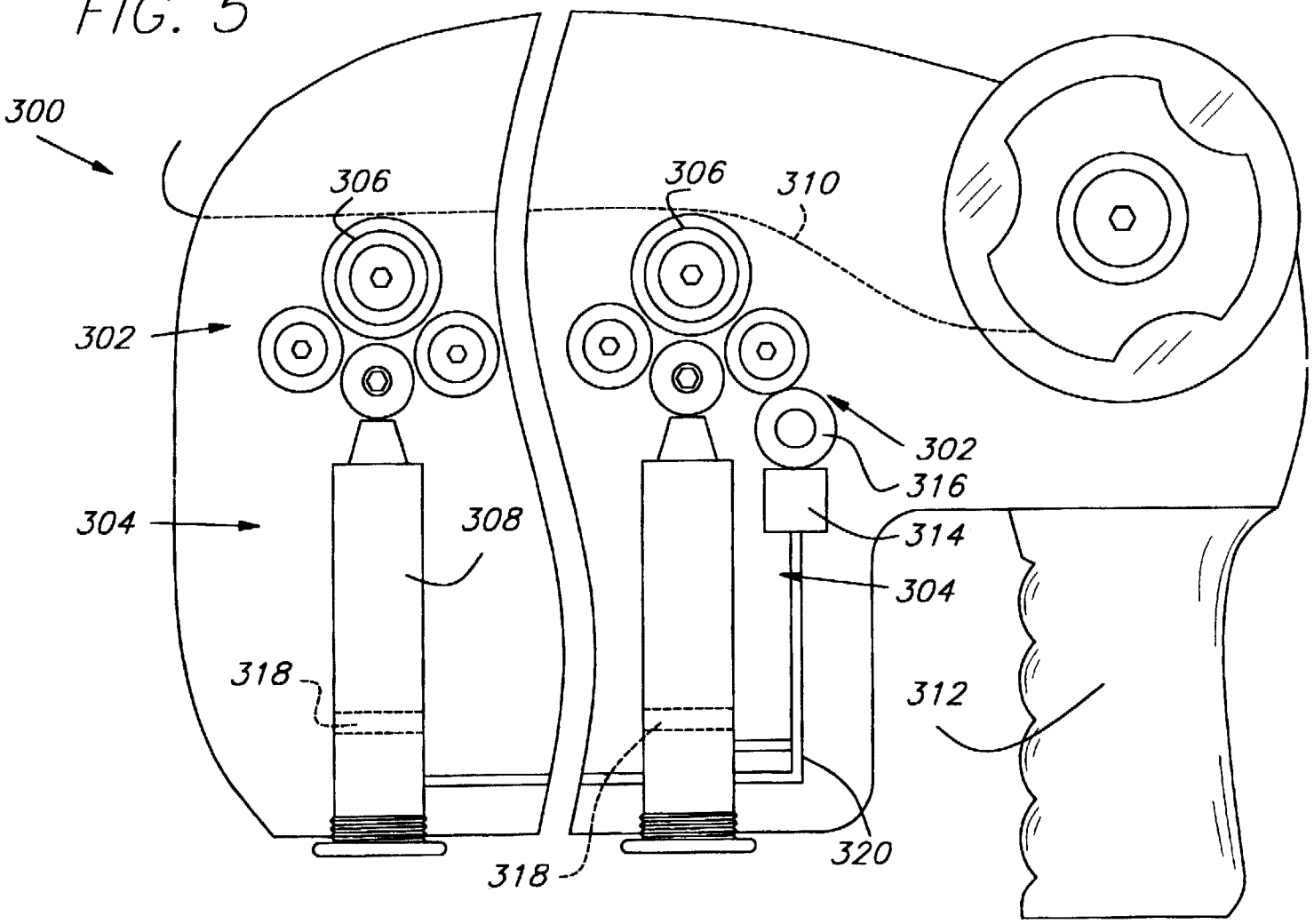
FIG. 5 is a schematical view of a multi-color hand-held printer having preferably from two to four sets of printing plates and cartridges in accord with the present invention.

Referring now to FIG. 5, there is schematically shown another hand-held printer 300 embodiment of the present invention that may be used to provide for two or more colors. An additional printer section 302 and ink cartridge are provided for each color ink to be used up to four colors whereby all colors, as well as a black ink section, may be printed as is well known to those skilled in the art. Each plate roller 306 has a pattern for a particular color ink 308. The plate rollers are preferably gear coordinated so that the desired printers are exactly aligned to produce the desired mark or image on tape 310. It will be apparent that the spacing between the cartridges may be much closer than shown in the schematic of FIG. 5. Cartridges 304 and plate rollers 306 may be used and substantially formed as described hereinbefore and may be constructed in a substantially light-weight manner so that hand-held printer 300 is easily carried via handle 312.

To compress the wet ink from all cartridges 304, a gas compression pump 314 may be driven by gear 316 that connects to gear train, plate rollers 302, or driven by the tape itself to produce a controlled pressure into cartridge 304 to drive respective pistons 318. A single compression pump 314 could be used along with a manifold distribution system 320. Alternatively each cartridge may have its own drive system that may be gas actuated or otherwise actuated, as previously discussed.

In summary, a cartridge such as cartridge 14 is used as a reservoir for wet ink. The wet ink is forced out of the cartridge at a precisely controlled rate that is dependent on the amount tape that goes past the printing plate. Preferably, the printing plate and means for controlling ink flow are gear driven for the most precise control but this is not absolutely necessary. The adhesive tape may provide sufficient friction with the printing plate or other roller to provide for good printing and ink flow with even fewer components. The ink cartridge may be a throw-away item or may be refillable as desired generally depending on the materials/design of the seals and bearings. It will be clear that many different types of materials, too numerous to list completely, could be used in the present apparatus and that therefore the invention is not limited to particular materials.

The foregoing disclosure and description of the invention is illustrative and explanatory thereof, and it will appreciated by those skilled in the art, that various changes in the size, shape and materials as well as in the details of the illustrated construction or combinations of features of the various coring elements may be made without departing from the spirit of the invention. For instance, if desired, the printing section could be part of the cartridge so that the entire unit is replaceable. In fact, the printer may be constructed simply enough so that the entire printer is effectively a throw-away item after the ink is depleted. Thus, many variations of the present invention are possible without departing from the spirit of the invention as described hereinbefore and in the subsequent claims.

What is claimed is:

1. A hand-held printer for marking on adhesive tape with wet ink, comprising:

a tape reel for holding said adhesive tape;

a plate roller for applying an imprint on said adhesive tape with said wet ink;

an ink cartridge body having an ink cartridge reservoir therein for said wet ink, said ink cartridge body having at least one aperture therein to dispense said wet ink; and a compressor for squeezing said wet ink within said ink cartridge reservoir to force said wet ink through said at least one aperture for application to said plate roller.

2. The hand-held printer of claim 1, wherein said compressor further comprises, a gas compressor for producing a pneumatic force.

3. The hand-held printer of claim 1, further comprising:

at least one ink roller for transferring said wet ink to said plate roller.

4. The hand-held printer of claim 1, further comprising:

a gear attached to said tape reel, said gear being operably connected to said compressor for compressing said ink in response to movement of said tape reel.

5. The hand-held printer of claim 1, further comprising:

a first ring having a wedge-shaped profile on at least a portion thereof.

6. The hand-held printer of claim 1, further comprising:

a shaft extending through said ink cartridge reservoir, said compressor being movably secured to said shaft.

7. The hand-held printer of claim 1, further comprising:

a rotatable cylinder operably connected to said compressor for compressing said wet ink.

8. The hand-held printer of claim 1, further comprising:

a second plate roller for applying a second color of wet ink.

9. A hand-held printer for printing on adhesive tape with wet ink, comprising:

tape path elements for directing said adhesive tape through said hand-held printer;

a printer member for printing with said wet ink onto said adhesive tape;

a reservoir containing said wet ink, said reservoir having an aperture at one end thereof; and a piston mounted in said reservoir for axial movement towards said aperture for compressing said wet ink from said reservoir to said printer member as said piston moves toward said aperture.

10. The hand-held printer of claim 9, further comprising:

a second reservoir containing a second color of wet ink.

11. The hand-held printer of claim 9, further comprising:

said piston being operable for compressing said wet ink through said aperture of said reservoir for application to said adhesive tape.

12. The hand-held printer of claim 9, wherein:

said piston is mounted for axial movement responsive to movement of said adhesive tape.

13. The hand-held printer of claim 9, further comprising:

one or more ridges secured to said reservoir, said piston being slidably mounted within said reservoir so as to be moveable in a first direction towards said aperture as said reservoir is depleted of said wet ink, said one or more ridges being mounted to prevent movement of said piston in a second direction opposite to said first direction.

14. The hand-held printer of claim 9, wherein:

said reservoir comprises a removable cartridge.

15. A method for printing onto adhesive tape with a hand-held printer, said method comprising:

moving said adhesive tape through said hand-held printer past a printing roller;

providing a wet ink from a group consisting of pastes, gels, pulps, or mashes;

compressing said wet ink contained within said hand-held printer through an aperture; and applying said wet ink to said printing roller.

16. The method of claim 15, wherein said step of compressing said wet ink further comprises:

moving a piston within a cylinder.

17. The method of claim 15, wherein said step of moving said ink further comprises:

moving a member within a reservoir.

18. The method of claim 15, wherein said step of compressing said wet ink further comprises:

producing pneumatic pressure.

19. The method of claim 15, further comprising:

replenishing said wet ink by replacing a cartridge.

* * * * *